US005572834A

United States Patent [19]

Lilly

[11] Patent Number: 5,572,834

[45] Date of Patent: Nov. 12, 1996

[54] CONSTRUCTION PREFORM FOR AN ARCHWAY

[76] Inventor: Darrel D. Lilly, 16510 W. Orangewood Ave., Litchfield, Ariz. 85340

[21] Appl. No.: 249,304

[22] Filed: May 25, 1994

[51] Int. Cl.[6] ..... E06B 1/14

[52] U.S. Cl. ..... 52/85; 52/204.2; 52/211

[58] Field of Search ..... 52/85, 86, 211, 52/212, 204.2, 204.53, 204.54, 745.15, 745.16; 405/124, 125, 134; 14/24, 25, 26; 264/32; 249/12, 36, 39, 209; D25/60, 61

[56] References Cited

U.S. PATENT DOCUMENTS 1,782,147 11/1930 Merryweather ..... 52/85
2,005,572 6/1935 Vass ..... 52/85
2,442,929 6/1948 Marino ..... 52/85
3,008,273 11/1961 Widin ..... 52/85
4,400,917 8/1983 Massaro et al. ..... 52/211

*Primary Examiner*—Michael Safavi
*Attorney, Agent, or Firm*—Joseph H. Roediger

[57] ABSTRACT

A preform for use in constructing an archway wherein opposing sheet metal cheek are spaced apart by a curved throat to permit the cheeks to reside between the adjacent wall support and the overlying wallboard or drywall. The preform is affixed directly to the support members. Drywall is fastened to the preform by screws with the seams between adjacent drywall sections being covered in the conventional manner. The attachment of the preform directly to the wall supports essentially eliminates the likelihood of joint separation or fastener movement after installation.

1 Claim, 2 Drawing Sheets

CONSTRUCTION PREFORM FOR AN ARCHWAY

BACKGROUND OF THE INVENTION

This invention relates to a construction preform for use in forming an archway in walls or door frames. In particular, the preform is affixed directly to the wall support members so as to provide a base for the wallboard or drywall used on the adjacent wall.

The construction of an archway has normally required the assembly of a wooden support at the construction site. Plywood is cut in a manner to provide the outline of the arch when completed. Two sections of plywood are separated by spacers which maintain the relative position of the two sections of plywood during affixation to the adjacent studs and headers defining the unfinished opening. After affixation of the curved plywood form, it has been common practice to affix strips of drywall to support pieces serving as spacers. Since the objective is to form a continuously curved surface along the exposed face of the intermediate supports, the use of thin strips of drywall to form the exposed surface of the archway is made to approximate a curve. The process of affixation of the drywall strips is time consuming. Attempts to cut wider strips to shorten construction time is limited by the desired contour. In order to finish the irregular approximation of the desired arch curve, the use of a drywall compound in substantial thickness is normally required. The construction process can result in a nonsymmetrical arch if great care is not taken.

In an attempt to overcome problems associated with the fabrication of an archway at the jobsite from the combination of contoured plywood, drywall and the intermediate support strips, prefabricated archways made from molded foamed plastics have been used. A prefabricated archway formed of molded polyethylene is described in U.S. Pat. No. 4,601,138 to Hampton wherein a relatively light weight arch can be brought to the location of the project and nailed or otherwise affixed directly to the framing of the adjacent wall. The prefabricated plastic archway is dimensioned to be conformably received in abutting relationship to the adjacent edges of the wall surfaces. The width from one outer surface to the opposing outer surface of the prefabricated archway is equal to the distance between the finished surfaces of the opposing walls. In other words, the arches are dimensioned to form a butt-joint against the existing drywall or wallboard. The prefabricated archway is secured in place by a series of nails applied through the exposed surface of the foam into the studs and headers comprising the support members. Following affixation, conventional taping is applied to the seam between foam and adjacent drywall. In practice, the seam between adjacent drywall and the foam arch has been found to display cracking due in part to the use of dissimilar materials at the seam thereby requiring future repair and maintenance. Also, the subsequent movement of nailheads outwardly and away from the foam archway creates an unsightly appearance requiring further maintenance.

The problems mentioned above in connection with prefabricated archways formed of foamed plastic is addressed in U.S. Pat. No. 4,665,666 to Hampton wherein the use of drywall paper in the molding process is recommended. During the formation of the archway, the reference teaches lining the mold with drywall paper which then becomes permanently bonded to the molded archway. As noted in the patent, the drywall paper strengthens the finished arch by adding a fibrous laminate to its exterior surface so as to reduce cracking. Furthermore, the use of the paper is intended to eliminate the "nail pops" occurring after installation. This modification to the construction of prefabricated archways is required because of the incompatibility of foamed plastic material with the wall-defining materials used in normal construction techniques. While the molded foam prefabricated archways accomplish the goal of eliminating the construction of coarse archway forms at the construction site, the problems arising from the use of a foamed material such as seam parting, cracking, nail popping and limited resistance to applied pressure remain.

Accordingly, it is a primary objective of the present invention to provide a durable archway preform which is complete when delivered to the construction site. In addition, an objective of the present invention is to provide a preform which allows the adjacent wall material to cover both the preform and adjacent wall surface in a continuous manner thereby eliminating seam parting or cracking. Also, the invention provides a preform which can receive threaded fastening devices thereby eliminating the maintenance problems associated with nails moving from their original position and causing unsightly surface damage.

SUMMARY OF THE INVENTION

The arch preform which is the subject of the present invention is dimensioned for placement in the framed opening in the surface of a wall, either during initial construction or during a remodel. The present invention is directed to a preform that can be utilized at one corner of a framed opening with a mating preform used at the opposing corner or a single preform can be fabricated to extend between the spaced vertical support members in the framed opening. The dimensions of the opening in the wall to receive the preforms are determined by the aesthetics and functionality of the room design and normally do not require the construction of special dimensioned preforms. The use of a pair of arch preforms spaced at opposite ends of the header extending over the framed opening provides flexibility to the designer regarding the width of the opening.

The subject preform is comprised of first and second cheek members formed of sheet metal. The cheek members have two generally orthogonally disposed edges with each of these edges terminating in a free end. A curvilinear edge extends between the free ends in accordance with the general shape to be attained through the use of the preforms. A curved metal throat member of sheet metal is shaped to conform with the curvilinear edge. The width of the throat member is made equal to the width of the support members in the framed opening to enable the orthogonally disposed edges of the cheek members to be inserted adjacent to the support members defining the framed opening, and reside underneath the drywall or wall board. Thus, the wallboard or drywall used to form the adjacent walls extends outwardly over the metal cheek members without creating an exposed seam. The arch preform is secured to the adjacent support members, typically the vertical studs and the horizontal header extending therebetween, during initial construction with the sheets of wallboard or drywall then affixed to extend over the support members and metal cheek members. The edge of the wallboard is cut to have the same curvilinear edge as the cheek members.

The arch preform includes means for affixing the throat member to the curvilinear edges of the cheek members, typically by forming a flange on the curvilinear edges of the cheek members and utilizing spot welding. By fabricating the cheek members and throat member of sheet metal, the conventional drywall screws are used to affix the wall covering to the adjacent cheek member. In addition, sections of drywall can be fastened by screws to the curved metal throat member and later covered with drywall compound. The finishing of the surface of the curved portion of the archway takes place with the arch preform affixed and in position in the wall opening thereby facilitating the finishing process. A conventional flexible corner bead can be used along the corners of the covered preform, if desired.

The present invention provides a support structure which securely receives the conventional threaded fasteners used in affixing drywall and provides a finished archway in which the wall surface is formed of a continuous sheet of wall covering. No seams are present and no juncture between dissimilar materials occurs so that the tendency to exhibit cracking is essentially eliminated. Further features and advantages of the invention will become more readily apparent from the following detailed description of a preferred embodiment when taken in conjunction with the accompanying drawings.

DESCRIPTION OF THE PREFERRED EMBODIMENT

Figure 1:
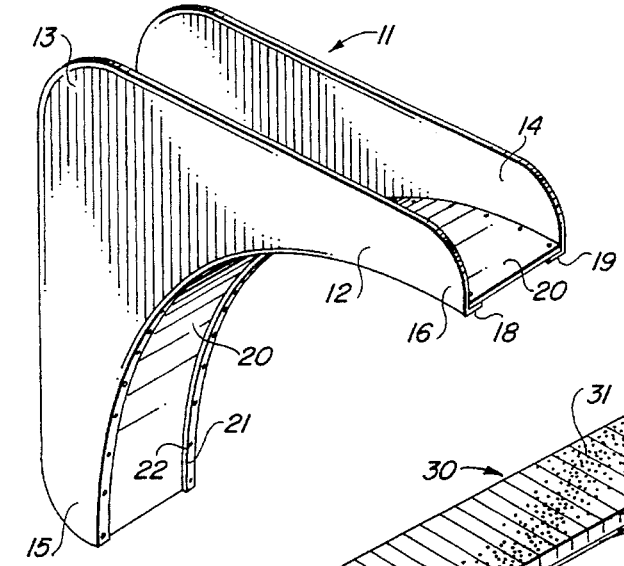
FIG. 1 is a view in perspective of an arch preform constructed in accordance with the present invention.

Referring now to FIG. 1, an arch preform for attachment for a framed opening in the surface of a wall is shown. The arch preform 11 is formed of a first cheek member 12 and a second cheek member 14 interconnected by a curved throat 20. The three elements are fabricated from sheet metal. The use of this material enables the curved throat member to be readily formed in the desired curvilinear pattern. In addition, the first and second elements 12 and 14 are provided with flanges 18 and 19 extending along the curved dimension thereof.

Figure 2:
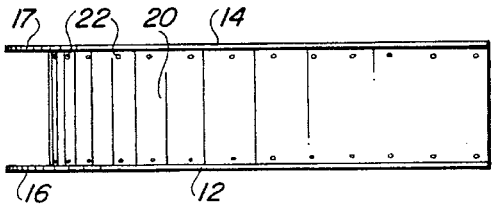
FIG. 2 is an end view of the embodiment of FIG. 1.

Each cheek member has two generally orthogonally disposed edges joined at a rounded corner 13. Each of the edges terminate in a pair of free ends 15 and 16. The free ends are back cut as shown in FIG. 1 to provide a generally rounded free end to aid in installation. In the manufacture of the arch preform shown in FIG. 1, first and second cheeks 12 and 14 are initially identical planar members. After cutting to the desired shape, the curved edge is subjected to a roller which forms a one quarter (¼") inch flange therealong. Since the flange is narrow and the bending is being conducted on a sheet metal part, no cuts or relief kerfs need be formed in the flanges. The throat 20 is generally rectangular in shape after cutting. It is then subjected to a bending step to conform to the curvilinear shape of the flanges formed on the cheek members. Next, the throat 20 is affixed to the flanges by a series of spot welds as shown in the end view of FIG. 2. The use of sheet metal in the construction of the three elements of the arch preform facilitates construction, provides durability to the unitary body and allows flexibility of the cheek members to aid in installation.

Figure 3:
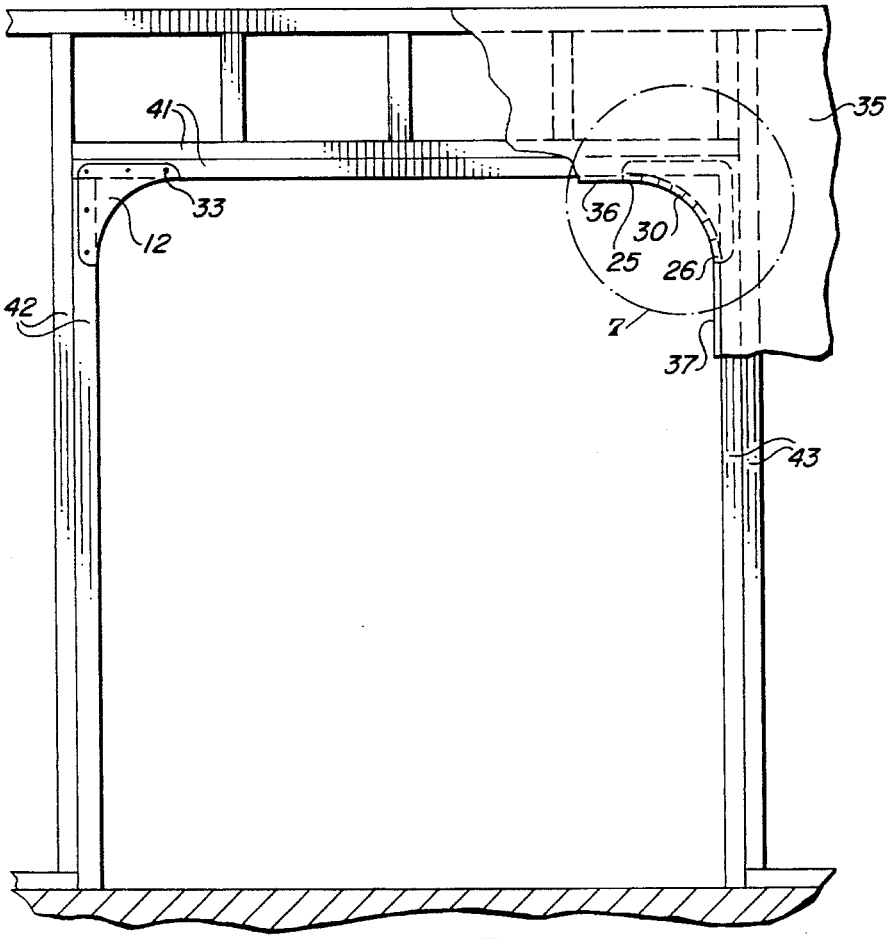
FIG. 3 is a view in partial cross section of a pair of arch preforms attached to a framed opening.
Figure 6:
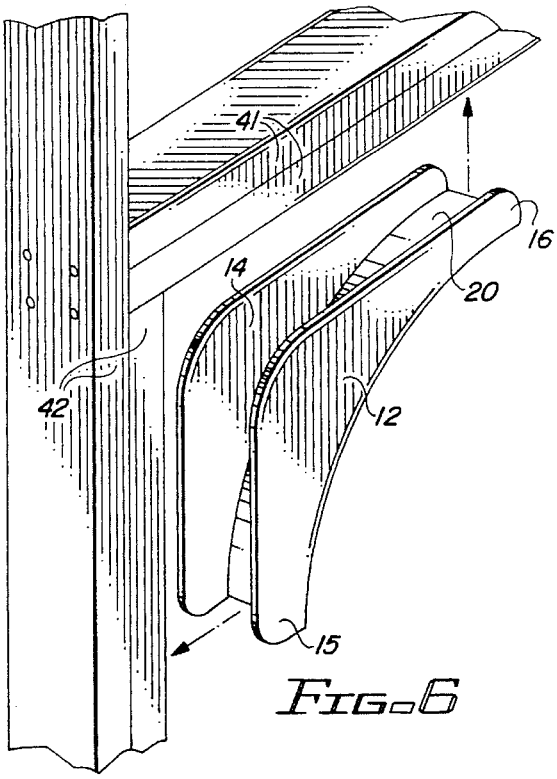
FIG. 6 is a view in perspective showing installation of the embodiment of FIG. 1.

The curved throat 20 is shown in FIG. 1 as a 90 degree continuous arc. It should be noted that the cheeks 12 and 14 can be precut according to a variety of patterns which may include a pattern having a discontinuity therein. The throat is initially formed as a rectangle and is preshaped to conform with the silhouette of the curved edge extending between free ends 15 and 16. The width of the throat member 20 is equal to the width of the framing members used in defining the opening in the wall. In the case of conventional construction, a wall opening is framed as shown in FIG. 3 with a pair of studs 42 providing vertical support. The inner most stud on either side of the opening is terminated short of the ceiling beam to receive a pair of headers 41 extending therebetween. The width of these studs and headers is 3½ to 3⅝ inches. This is the actual width of the conventional two by four wood member used in framing. Since the wood members used in framing are not of the highest grade, they may contain irregularities and be subject to warping, the flexibility of the sheet metal cheek members enables the arch preform to accommodate run of the mill framing members. The installation of the arch preform is shown in FIG. 6 wherein the generally orthogonally disposed edges slide over the adjacent studs 42 and header 41. When in place as shown in FIG. 3, the portion of the throat 20 adjacent free end 15 is in contact with the inner most stud 42. Similarly, the portion of the throat 20 adjacent free end 16 is in contact with the bottom header 41. At this time in the construction process, the arch preform is nailed directly to the adjacent framing member by nails 33.

Figure 7:
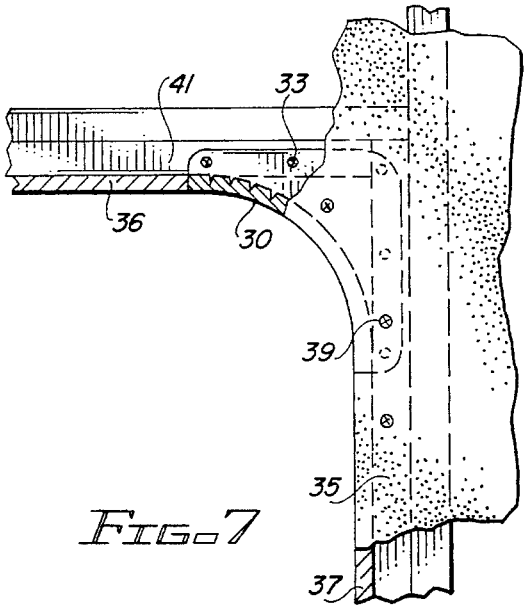
FIG. 7 is an exploded view of the encircled portion of FIG. 3.

The completed installation of the arch preform is shown in FIG. 3 and the exploded portion thereof in FIG. 7 wherein the large planar wall covering 35, normally a drywall panel is attached to the framing in a conventional manner by the use of phillips head drywall screws. The panel can be precut to the contour of the preform archway by tracing an outline on the drywall prior to installation. The use of sheet metal for the first and second cheek members allows a threaded fastener to be used to affix the wall covering to the arch preform. The positive engagement provided by the threaded fasteners reduces the likelihood that there will be any backing off and resultant disturbance created on the finished surface. In the case of nails used in combination with drywall, it is common to have nail popping take place later with the result that refinishing is required to restore the wall surface to its original condition. It is important to note from FIG. 7 that the cheek members are received between the wall board panel and the stud members without creating exposed seams. Heretofore, prefabricated arches have utilized butt joints with the wall board which frequently give rise to visible cracks over extended periods of time. This undesirable result is more likely to occur when dissimilar materials are used in the butt joints as is the case with foamed archways abutting drywall panels.

Figure 5:
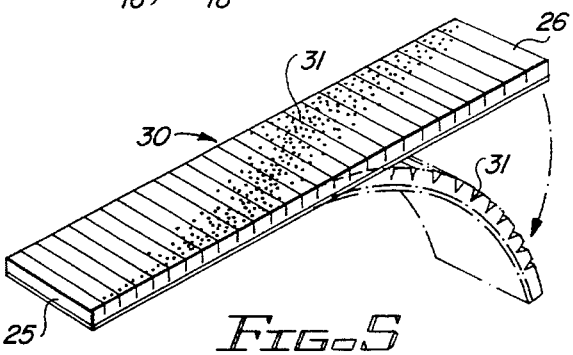
FIG. 5 is a view in perspective of a section of drywall for affixation to the throat of the embodiment of FIG. 1.
Figure 4:
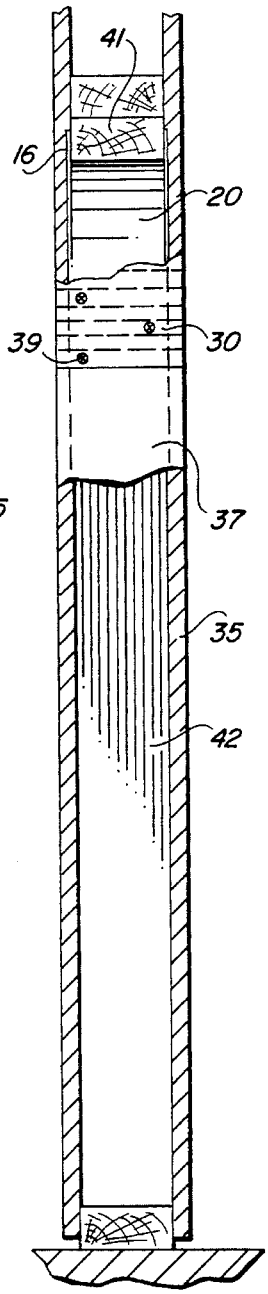
FIG. 4 is an end view in partial section of FIG. 3.

The throat 20 of the device is covered by a section of drywall 30 having a multiplicity of transverse slots 31 cut therein as shown in FIG. 5. The slots or kerfs extend partially through the drywall and permit flexure of the section without damaging the surface layer. In FIG. 3, the upper end 25 of the section 30 is shown extending to the free end 16 of the preform. Similarly, the lower end 26 of drywall section 30 extends downwardly to free end 15. The drywall section 30 is affixed to the preform by the use of conventional drywall screws threaded into the throat 20. As shown in FIG. 4, drywall strips 36 and 37 are affixed to the exposed widths of header 41 adjacent ends 25 and 26 respectively. The seams between the drywall section 30 and adjacent drywall strips 36 and 37 are taped and drywall compound is applied in the normal manner. The drywall strip 30 can be made longer than the kerfed strip shown in FIG. 5 so that the seams are spaced from the free ends of the arch preform if desired. In both cases, the seam is formed between similar materials and is a conventional drywall seam formed on the width of the underlying stud. The placement of strip 30 on throat 20 is seen in the end view of FIG. 4 with vertical drywall strip 37 adjacent thereto. The drywall panels 35 are shown in cross section affixed to adjacent stud 42. A similar juncture is formed with header 41 at free end 16 of the arch preform 11.

Figure 8:
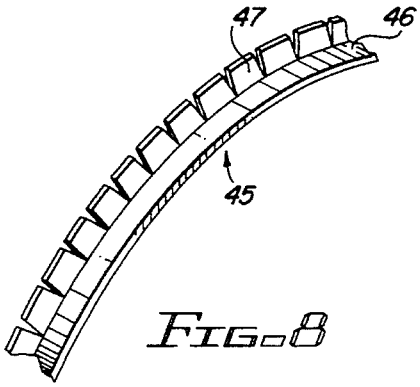
FIG. 8 is a view in perspective of a flexible corner bead for use in connection with the present invention.
Figure 9:
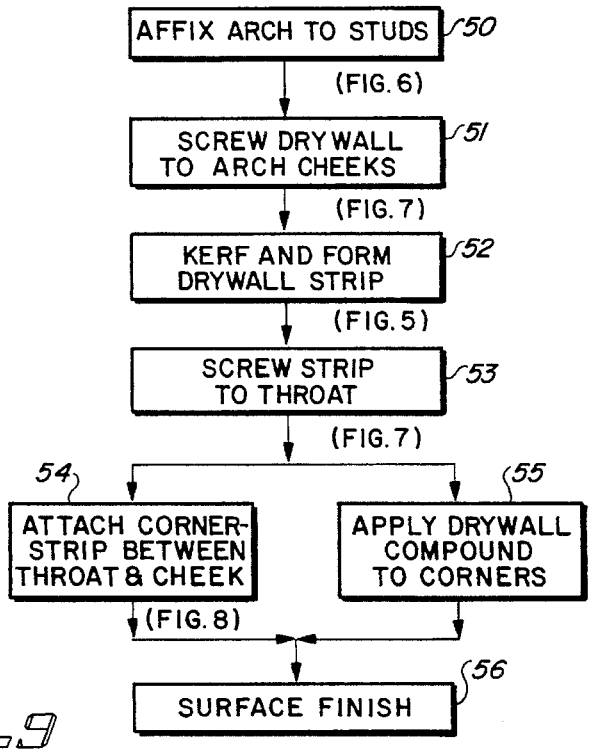
FIG. 9 is a block diagram of the sequence of steps employed in practicing the present invention.

The exposed edges of the drywall panels formed at the corners are generally covered with conventional corner bead strips. In the installation of other types of wall board coverings, the drywall section 30 is replaced with a corresponding sized panel of the flexible paneling and conventional anchors are used. Flexible corner members, typically colored plastic beading, are used to complete the juncture between panels. A typical flexible corner bead 45 for drywall is shown in FIG. 8 as comprising a lengthwise strip 46 and a segmented strip 47 affixed thereto at a right angle. The lengthwise strip 46 is located on the drywall member 30 and secured to the throat 20. The segments 47 separate to permit contouring of the corner bead. Following the installation, the drywall compound is placed in the recesses containing the drywall screws and applied to the seam tape in layers in the conventional manner. After several applications, the applied compound is smoothed and the desired final surface finish applied. As mentioned previously, the width of throat 20 is made equal to the nominal width of the support members used in framing the opening receiving the preforms. In general, this is the nominal width of the standard framing 2×4. In the preferred embodiment of the invention, the throat is affixed by spot welding to flanges formed on the first and second cheek members. The placement of the flanges on the cheek members provides a smooth planar surface for the affixation of the large area panels. The free ends of the cheek members are cut back to be rounded to facilitate the insertion of the preform beneath existing drywall in the case of remodeling of an opening as an archway. The rounded free ends enable the preform to be rotatably inserted between the wall covering and the underlined framing. It is to be noted that the use of sheet metal not only provides flexibility and durability, but enables the wall board to be affixed thereto using conventional threaded fasteners.

While the foregoing description has referred to a preferred embodiment of the invention, it is to be noted that variations and modification can be made therein without departing from the scope of the invention as claimed.

I claim:

1. An arch construction for the framed opening in a wall having overlays of wallboard forming the opposing exterior surfaces thereof which comprises:

a) a frame including spaced vertical support members and a header member extending therebetween, said members having a defined width equal to the spacing between the overlays of wallboard, and b) an arch preform comprising:

i. first and second planar metal cheek members for placement adjacent to said support and header members and receiving an overlay of wallboard thereon, said cheek members each having two generally orthogonally disposed edges for affixation to a vertical support member and a header, each of said edges terminating in a free ends with a curvilinear edge extending between free ends;

ii. a curved throat member shaped to conform with said curvilinear edge and having a fixed width equal to the defined width of said support and header members; and iii. first and second flanges extending along the curvilinear edges of the first and second cheek members respectively, said flange to be affixed to the throat member, the overlays of wallboard covering the first and second cheek members and forming the exterior surfaces of the arch construction.

* * * * *

UNITED STATES PATENT AND TRADEMARK OFFICE

CERTIFICATE OF CORRECTION

PATENT NO. : 5,572,834

DATED : November 12, 1996

INVENTOR(S) : Darrel D. Lilly

It is certified that error appears in the above-identified patent and that said Letters Patent are hereby corrected as shown below:

Claim 1. An arch construction forming a framed opening in a wall having overlays of wallboard forming the opposing exterior surfaces thereof which comprises:

a) a frame including spaced vertical support members and a header member extending therebetween, said members having a defined width equal to the spacing between the overlays of wallboard, and b) an arch preform comprising:

i. first and second planar metal cheek members adjacent to said support and header members and receiving an overlay of wallboard thereon, said cheek members each having two generally orthogonally disposed edges fixed to a vertical support member and a header, each of said edges terminating in a free ends with a curvilinear edge extending between free ends;

ii. a curved throat member shaped to conform with said curvilinear edge and having a fixed width equal to the defined width of said support and header members; and

UNITED STATES PATENT AND TRADEMARK OFFICE

CERTIFICATE OF CORRECTION

PATENT NO. : 5,572,834

DATED : November 12, 1996

INVENTOR(S) : Darrel D. Lilly

It is certified that error appears in the above-indentified patent and that said Letters Patent is hereby corrected as shown below:

iii. first and second flanges extending along the curvilinear edges of the first and second cheek members respectively, said first and second flanges affixed to the throat member, the overlays of wallboard covering the first and second cheek members and forming the exterior surfaces of the arch construction.

Signed and Sealed this

Eleventh Day of March, 1997

*Attest:*

Bruce Lehman

BRUCE LEHMAN

*Attesting Officer*

*Commissioner of Patents and Trademarks*